US005894672A

United States Patent [19]

Ellenburg et al.

[11] Patent Number: 5,894,672

[45] Date of Patent: Apr. 20, 1999

[54] ENHANCED SIGHT MARKER APPARATUS

[75] Inventors: Mark Owen Ellenburg, New York, N.Y.; Howard Steve Ellenburg, Boulder, Colo.

[73] Assignee: Trumark Manufacturing Company, Boulder, Colo.

[21] Appl. No.: 08/911,327

[22] Filed: Aug. 14, 1997

[51] Int. Cl.[6] ..... F41G 1/46

[52] U.S. Cl. ..... 33/265; 124/20.1

[58] Field of Search ..... 33/241, 243, 265; 124/20.1; 250/484.4; 385/147

[56] References Cited

U.S. PATENT DOCUMENTS

| | | | |
|---|---|---|---|
| 837,562 | 12/1906 | Hartmann . | |
| 844,665 | 2/1907 | Dills | 124/20.1 |
| 2,610,405 | 9/1952 | Dickinson | 33/47 |
| 2,706,335 | 4/1955 | Munsey | 33/47 |
| 3,098,303 | 7/1963 | Plisk | 33/52 |
| 3,218,718 | 11/1965 | Hays | 33/241 |
| 3,578,973 | 5/1971 | Dooley et al. | 250/71 |
| 3,949,482 | 4/1976 | Ross | 33/241 |
| 4,030,203 | 6/1977 | Ackerman, Jr. | 33/241 |
| 4,070,763 | 1/1978 | Carts, Jr. | 33/241 |
| 4,198,949 | 4/1980 | Cook | 124/20.1 |
| 4,422,719 | 12/1983 | Orcutt | 350/96.3 |
| 4,625,421 | 12/1986 | Strauss | 33/265 |
| 4,743,765 | 5/1988 | Ekstrand | 250/467.1 |
| 4,918,823 | 4/1990 | Santiago | 33/241 |
| 4,993,158 | 2/1991 | Santiago | 33/253 |
| 5,065,519 | 11/1991 | Bindon | 33/241 |
| 5,201,124 | 4/1993 | Sherman | 33/241 |
| 5,291,577 | 3/1994 | Zoscak | 385/147 |
| 5,442,861 | 8/1995 | Lorocco | 33/241 |
| 5,560,113 | 10/1996 | Simo et al. | 33/265 |
| 5,619,801 | 4/1997 | Slates | 33/241 |
| 5,638,604 | 6/1997 | Lorocco | 33/241 |
| 5,685,081 | 11/1997 | Winegar | 33/265 |
| 5,803,067 | 9/1998 | Ellenburg et al. | 124/20.1 |

FOREIGN PATENT DOCUMENTS

| | | | |
|---|---|---|---|
| 0128753 | 7/1984 | European Pat. Off. . | |
| 0470016 | 6/1992 | European Pat. Off. . | |
| 3813258 | 11/1989 | Germany . | |
| 4214997 | 11/1993 | Germany . | |
| 53-31399 | 3/1978 | Japan . | |
| 1-211702 | 8/1989 | Japan . | |
| 2035106 | 6/1980 | United Kingdom | 124/20.1 |

OTHER PUBLICATIONS

Brochure Opti9702, entitled "OptiBright® Scintillating Fibers" of Poly–Optical Products, Inc., Irvine, California (no date).

Stanislawski Archery Products, 1991 (no month).

Photos of Alleged Prior Products, no dates, "Prior 1, Prior 2, Prior 3, Prior 4".

Toxonics' 1998 Catalog of Bowsights & Accessories.

Golden Key & Photo's—"Glo–Sight" (dates unknown).

*Primary Examiner*—G. Bradley Bennett

*Attorney, Agent, or Firm*—Townsend and Townsend and Crew

[57] ABSTRACT

An enhanced sight marker apparatus for slingshots, bows, and other projectile launching devices includes a support block with a trough for mounting and retaining an elongated, fluorescent optical fiber. The trough is deep enough to receive a substantial portion of the fluorescent optical fiber for support while leaving some portion of the peripheral surface of the optical fiber unshielded by the support block for exposure to ambient electromagnetic radiation, and the support block also leaves at least one end of the fluorescent optical fiber exposed and visible so that light transmitted in the core of the optical can be propagated from the exposed end to a user's eye.

14 Claims, 7 Drawing Sheets

ENHANCED SIGHT MARKER APPARATUS

BACKGROUND OF THE INVENTION

1. Field of the Invention

This invention relates to sight apparatus used for aiming projectiles and more specifically to enhanced visibility sights for projectile launching apparatus such as slingshots, bows, and the like.

2. Description of the Prior Art

Sights have been used for a very long time on apparatus used to launch projectiles, such as firearms, bows, and slingshots. For example, the slingshot apparatus that is shown and described in the U.S. patent application Ser. No. 08/666,000, by H. Ellenburg et al., filed on Jun. 12, 1996, which is incorporated herein by reference, includes a pair of pivotal sights mounted on the fork branches of a slingshot to extend into the field of vision for the path of a projectile to be launched by the slingshot and which pivot out of the projectile long path as the sling strap is released. Such sights are quite effective and easy to use, but they do require a certain degree of concentration by the user, who has to see not only the sight in the near field of vision, but also the target in the far field of vision, while holding the slingshot, stretching the sling straight rearwardly and aligning the sights with the target while taking into account the distance and likely drop in the projectile path and sometimes movement of the target. Such parameters are not unique to slingshots, however. Shooting a bow and arrow, for example, requires similar considerations and concentration.

Sight visibility has been enhanced with fluorescent fiber optics in some projectile launching apparatus recently, such as the bow sights manufactured by Toxonic Manufacturing Co., of 1324 Wolmer Road, Wentzville, Mo. 63385. Essentially, a length of optical fiber with a core that is doped with fluorescent pigment material is used to gather some amount of energy, usually nonvisible and visible electromagnetic radiation such as ultraviolet and visible light, to produce colored visible light and guiding that colored visible light to one or more points on the sight. The colored visible light emanating from the optical fiber enhances visibility of the sight and reduces concentration needed for the rear vision field, thereby allowing more concentration on the target in the far vision field. However, such optical fibers are somewhat delicate and fragile, thus vulnerable to breakage or damage in a rough use environment, such as hiking and packing in back country or simply use by juveniles, who may not always be as careful in their youthful enthusiasm as an adult. Therefore, while such fluorescent optical fibers are known to enhance visibility of sights, more rugged mounting structures that protect the optical fibers while not inhibiting energy gathering capability are needed to make such fiber optically enhanced sights feasible for projectile launchers, especially launchers such as slingshots, bows, and the like, that are used often by juveniles or in other rough use environments.

SUMMARY OF THE INVENTION

Accordingly, it is a general object of the present invention to enhance visibility of sights on slingshots and other projectile launching apparatus.

A more specific object of this invention is to improve ruggedness and durability of optical fiber enhanced sights, especially for slingshots and other projectile launching apparatus.

A still more specific object of this invention is to provide improved support and protection for optical fibers in sight applications while not inhibiting energy gathering capability of the optical fiber.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

To achieve the foregoing and other objects and in accordance with the purposes of the present invention, as embodied and described herein, the fiber optic sight marker apparatus may include, but is not necessarily limited to, an elongated sight bar, an elongated fluorescent optical fiber with at least one of its ends extending transversely through the sight bar, and a support block with a groove in its surface to receive and support the length of optical fiber while leaving a substantial portion of the peripheral surface of the optical fiber exposed to ambient visible and invisible light energy. The support block can have a semicircular shape so that both ends of the optical fiber can extend through the sight bar toward the user's eye.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figure 1:
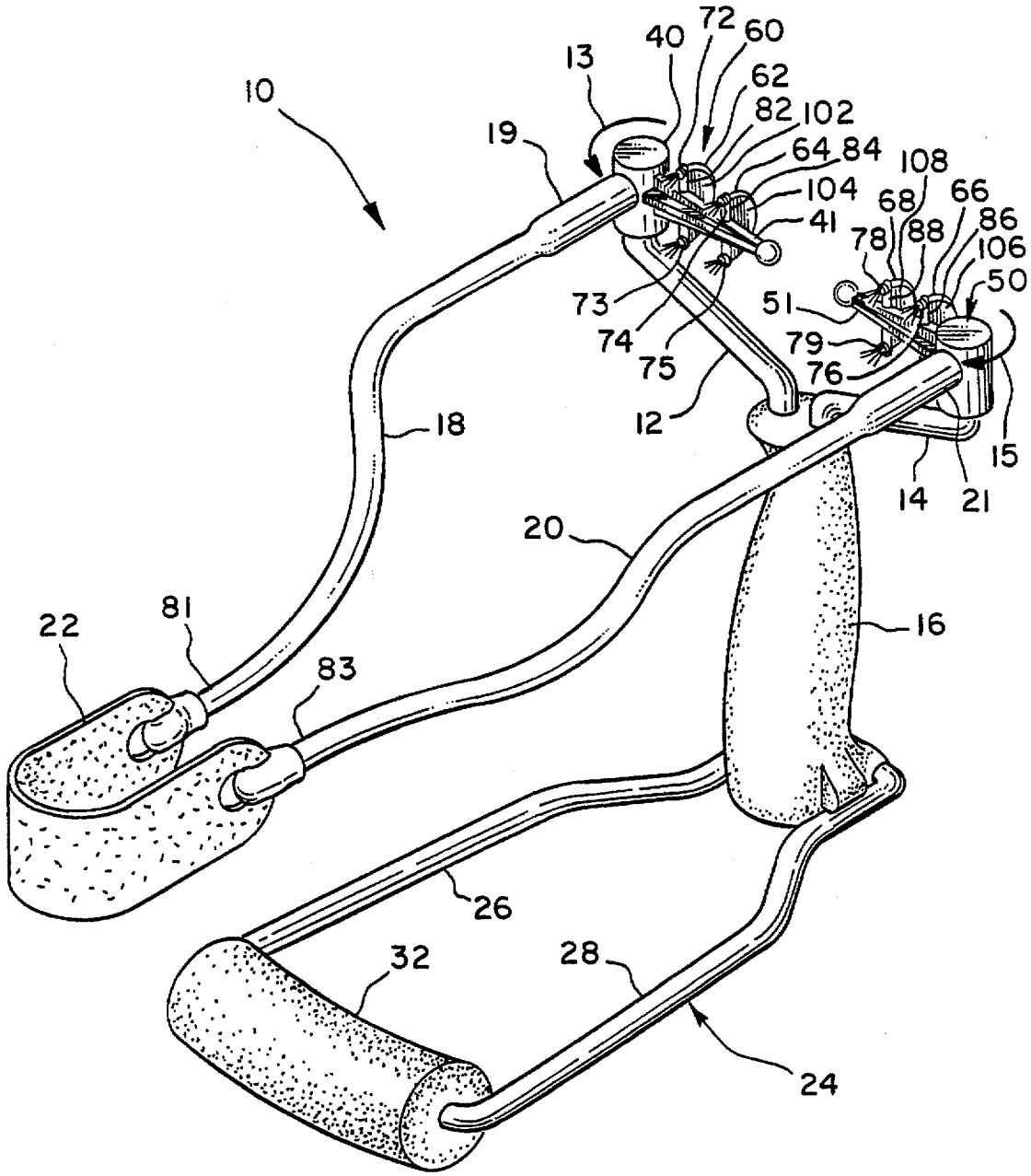
FIG. 1 is an isometric view of a slingshot equipped with the fluorescent fiber optic sight markers of this invention.

A slingshot 10 equipped with fluorescent fiber optic sight markers 60 according to this invention is shown in FIG. 1.

Each fluorescent optical fiber 62, 64, 66, 68 captures ambient light—some visible, but mostly invisible—and converts the captured light energy to visible light, which it then channels to respective ends 72, 73, 74, 75, 76, 77, 78, 79, where it is emitted to make the ends 72, 73, 74, 75, 76, 77, 78, 79 glow brightly as compared to the ambient lighting. Such glowing ends 72, 73, 74, 75, 76, 77, 78, 79 serve as sight markers that enhance visibility of the sight bars 82, 84, 86, 88 in which they are mounted As general background, the fluorescent fiber optic sights 60 can be used or easily adapted to be used on any slingshot or other projectile launching device. For purposes of illustration, but not for limitation, slingshot 10 shown in FIG. 1 can be similar to the slingshot shown and described in the patent application Ser. No. 08/666,000, of H. Ellenburg et al., filed on Jun. 12, 1996, which is incorporated herein by reference. A detailed description of such a slingshot structure is shown and described in that patent application, and additional details of such a slingshot can be seen in U.S. Pat. No. 4,250,861, which is also incorporated herein by reference. For purposes of this invention, suffice it to say that the slingshot 10 has a Y-shaped frame comprised generally of two breaches 12, 14 of a yoke extending upwardly and outwardly from a handle or hand grip 16, two elastic or rubber sling straps 18, 20 connected at their proximal ends 19, 21 to the respective yoke branches 12, 14 and connected at their distal ends 81, 83 to a pouch 22, and a wrist brace 24 comprising rearwardly extending rigid members 26, 28 and a traverse end member 30 covered by a cylindrical cushion 322. Two sight struts 41, 51 extend generally toward each other from respective pivotal connectors 40, 50, which pivot on respective yoke breaches 12, 14, as indicated by arrows 13, 15 when the projectile (FIG. 2) is launched from pouch 22.

Figure 2:
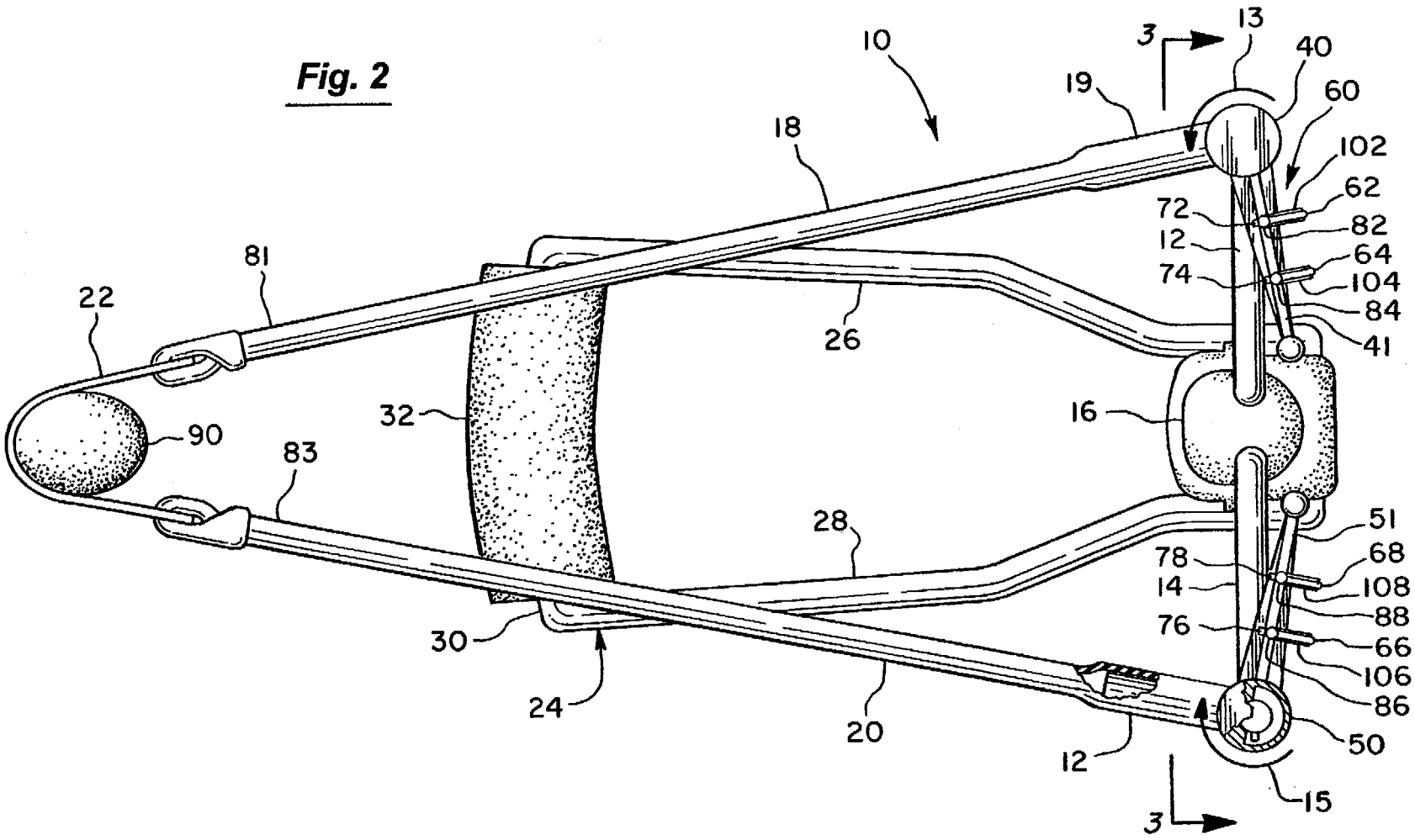
FIG. 2 is a top plan view of the slingshot equipped with the fluorescent fiber optic sight markers of this invention.
Figure 3:
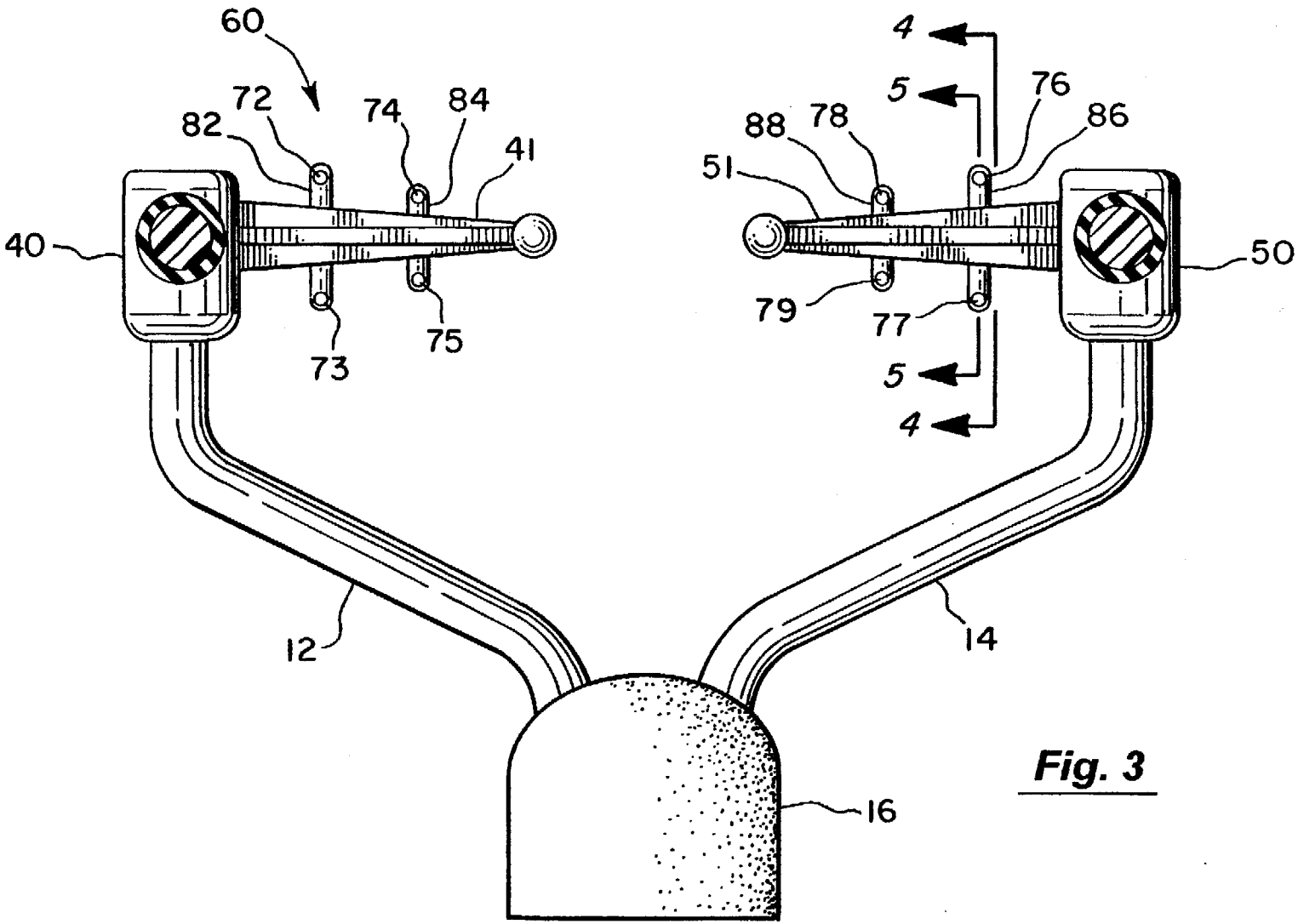
FIG. 3 is a rear elevation view of the slingshot equipped with the fluorescent fiber optic sight markers taken along line 3—3 of FIG. 2.
Figure 4:
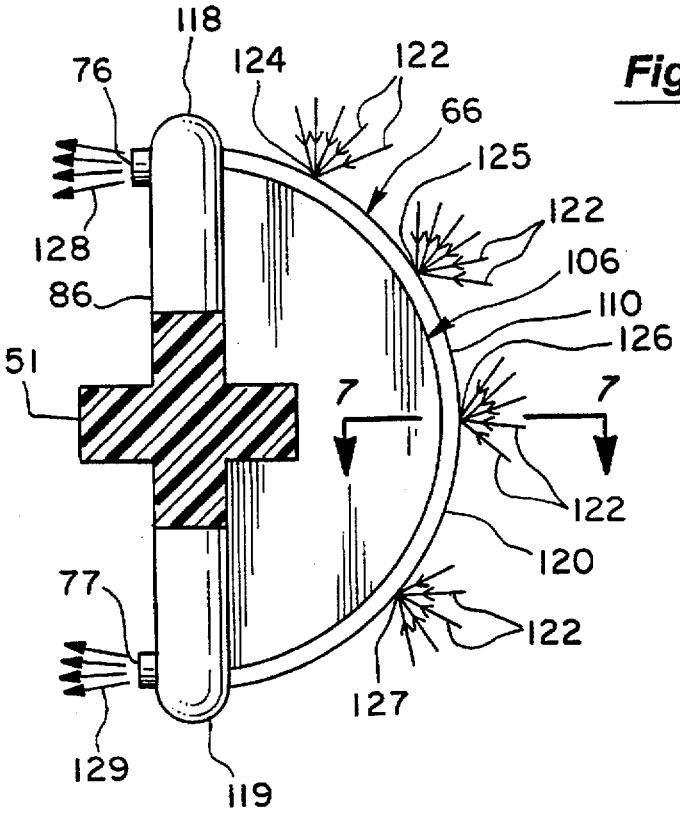
FIG. 4 is a right side elevation view of one of the fluorescent fiber optic sight markers of this invention taken along line 4—4 of FIG. 3.
Figure 5:
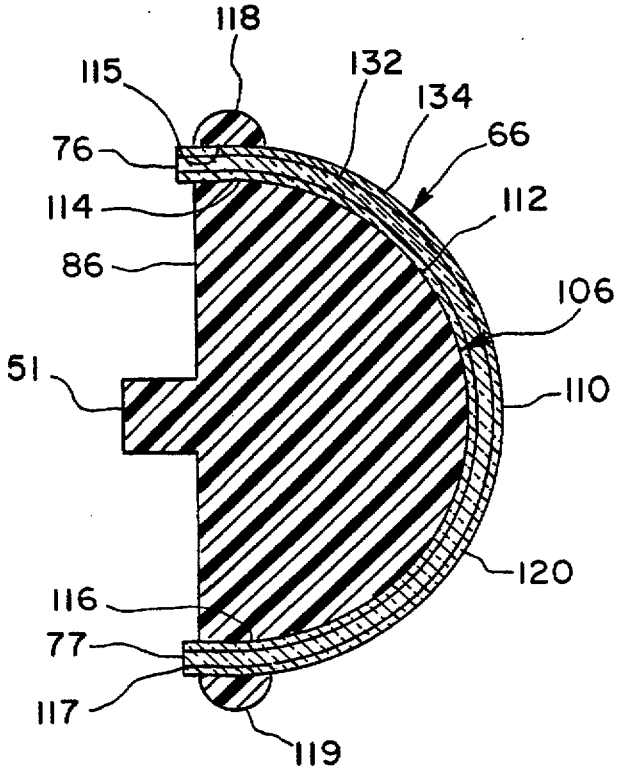
FIG. 5 is a cross-sectional view of one of the fluorescent fiber optic sight markers of this invention taken along line 5—5 of FIG. 3.

Referring now primarily to FIGS. 4 and 5 in combination with FIGS. 1–3, the fluorescent optical fiber 66 and support block 106 is typical of the structures of the other optical fibers 62, 64, and 68 and respective support blocks 102, 104, and 108 of this invention. Essentially, the support block 106 according to a preferred embodiment of this invention has a substantially semicircular shape and extends forwardly from the sight bar 86. The elongated fluorescent optical fiber 66 has a midportion 110 that is positioned in a groove 112 in the surface of the support block 106. It also has a first end portion 114 adjacent end 76 and a second end portion 116 adjacent end 77. The first end portion 114 of fluorescent optical fiber 66 extends through a first transverse hole 115 adjacent end 118 of the sight bar 86. The second 116 of fluorescent optical fiber 66 extends through a second hole 117 adjacent end 119 of the sight bar 86. The respective ends 76, 77 can, but do not have to, extend slightly through the sight bar 86 to form the sight markers 76, 77 as discussed above. The optical fluorescent fiber 66, when positioned with its midportion 110 in the groove 112, still has a substantial portion of its elongated cylindrical peripheral surface 120 exposed to ambient visible and nonvisible light energy, as indicated diagrammatically by representative rays 122. In most circumstances, the ambient light energy will be mostly diffuse light, although some direct sunlight might also be captured. The illustration in FIG. 4 shows diffuse light energy rays incident on four points 124, 125, 126, 127 being captured by the midportion 110 peripheral surface 120 of fluorescent optical fiber 66 and channeled or transmitted to the ends 76, 77, where the energy is emitted as visible light, as indicated by visible light rays 128, 129, respectively. Actually, the light energy 22 is incident on an infinite number of points on exposed peripheral surface 120, of which points 124, 125, 126, 127 are only representative. Not all incident rays 122 are captured, of course, as some are reflected immediately, absorbed, or lost during transmission. However, enough visible and nonvisible light rays 122 are captured over the entire exposed portion of the surface area 120, converted to visible light radiation by fluorescence in the optical fiber 66, and transmitted by the fluorescent optical fiber 66 to ends 76, 77 to make the ends on sight markers 76, 77 appear to glow brighter than the surrounding ambient visible light and natural environment.

Figure 6:
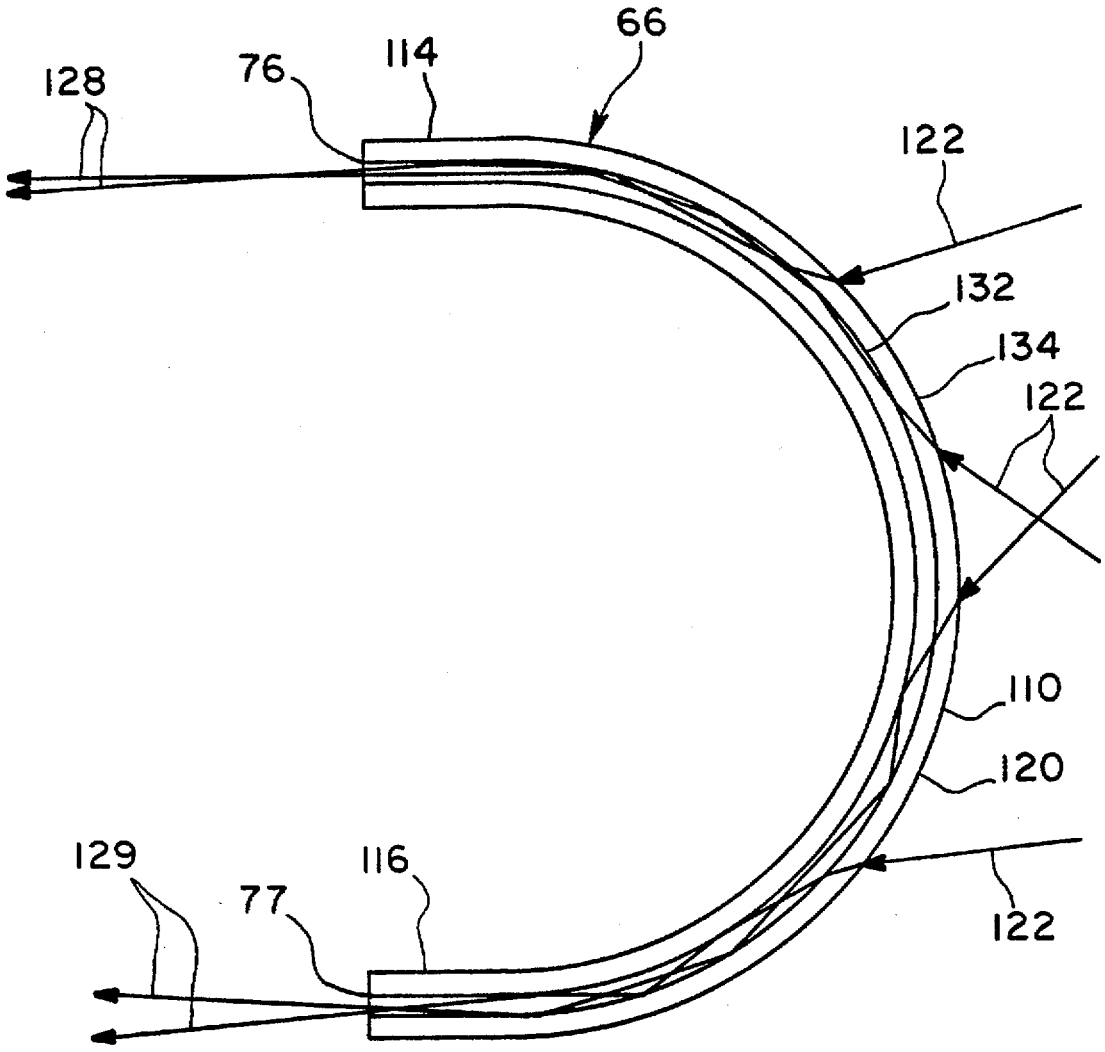
FIG. 6 is an enlarged view of the fluorescent optical fiber in right side elevation illustrating diagrammatically the visible and invisible light energy capturing and transmitting function of the fluorescent optical fiber in this invention.

Light energy captured by the fluorescent optical fiber 66 is illustrated diagrammatically in FIG. 6, which is a simplified explanation, certainly not sufficient for manufacture of fluorescent optical fibers, but sufficient for purposes of understanding this invention. A simple fluorescent optical fiber 66 may comprise a step index (SI) structure, as illustrated in FIG. 6, wherein a core 132 has a uniform, but much higher index of fraction $N_2$ of a cladding 134 that surrounds the core 132. If the core index of refraction varies with the core radius, the fiber would be a graded-index (GI) fiber, and there are many core and cladding shapes and variations that need not be discussed here. The core 132 contains fluorescent dopants, which absorb light energy—some visible light energy, but mostly nonvisible electromagnetic radiation, such as ultra-violet light energy—and in response emit visible light in a fluorescence spectra or radiation frequencies that are characteristic of the fluorescent dopants used. The dopants can be selected from fluorescent pigments that emit the visible light desired colors, i.e., wavelengths or frequencies, such as red or green fluorescent optical fibers suitable for this invention, such as the "OptiBright"™ Scintillating Fibers manufactured by Poly-Optical Products, Inc., of Irvine, Calif. 92614, are readily available and easily obtainable. Essentially, for a given ratio of $N_1$ to $N_2$, there is a critical light entrance angle to the fiber axis, below which virtually all light entering the optical fiber will be transmitted. Curving the optical fiber 66 as is shown in FIG. 6 adds to some loss of light, but not enough to defeat the effectiveness of the fiber 66 for purposes of this invention. The diagram in FIG. 6 indicates how some incident light rays 22 are refracted or bent initially upon entering the cladding 134 (going from air—a low index of infraction into the cladding—a higher index of refraction $N_2$), and then refracted again upon entering the core 132 (a much higher index of refraction $N_1$). In the core 132, the captured light energy, especially the nonvisible light energy, which is comprised mostly of ultra-violet light, excites the atoms or molecules of the fluorescent dopants in the core to emit visible light in a characteristic frequency or color. Those rays of emitted visible light that have a low enough effective angle of entrance in the core are then reflected at core/cladding interfaces to confine such emitted visible light to the core until it reaches the ends 76, 77, where it is emitted as visible light rays 128, 129. In reality, some of the emitted visible light may leak into the cladding 134 and escape or be reflected back, or it may even be transmitted by the cladding 134, depending on angles and indices of refraction. Overall, however, enough energy from incident visible and nonvisible light rays 122 is captured over the exposed peripheral surface 120 of optical fiber 66, converted by fluorescence to visible light radiation, and transmitted to ends 76, 77, to give a glowing appearance to ends 76, 77 as explained above. Fluorescent optical fibers 66 can be obtained with fluorescent pigment dopants in several color emitting varieties, so they produce and transmit mostly only light of one color, such as red or green, so the ends 76, 77 glow either red or green.

Figure 7:
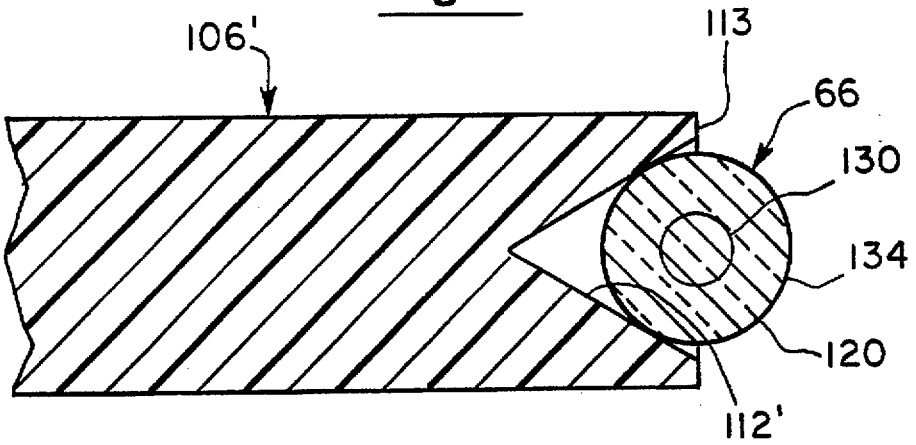
FIG. 7 is a fragmenting cross-sectional view of the support block and fluorescent optical fiber mounting of the present invention taken along line 7—7 of FIG. 4.

Referring now to FIG. 7, the support block 106 has a groove 112 sunk into its end surface 113 to receive and retain the fluorescent optical fiber 66. In a preferred embodiment, the groove 112 has a semicircular cross-section with about the same or only slightly larger radius as the fluorescent optical fiber 66, so that the fluorescent optical fiber 66 is well supported and protected laterally as well as transversely when nested in the groove 112, yet with about one-half of the diameter of the fluorescent optical fiber 66 extending radially outward from the end surface 113 to expose about one-half of the peripheral surface 120 to the incident light rays 122.

Figure 8:
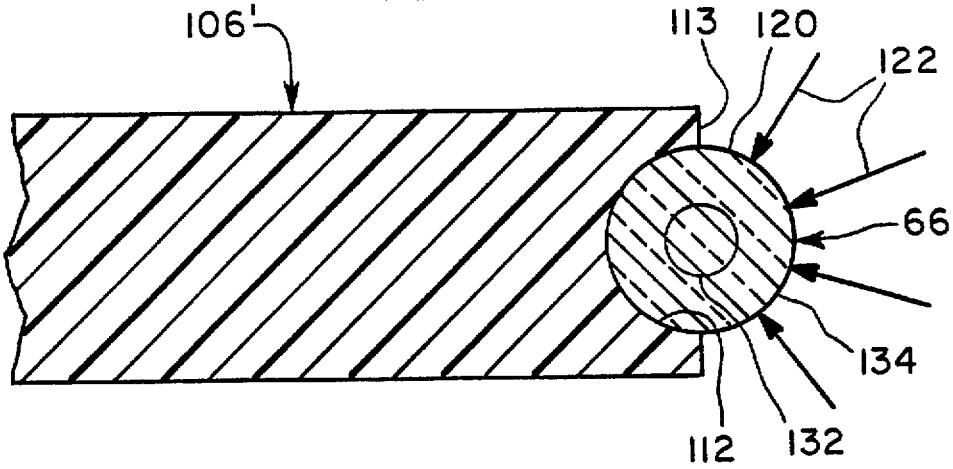
FIG. 8 is a fragmentary cross-sectional view similar to FIG. 7, but with a triangular-shaped groove cross-section.
Figure 9:
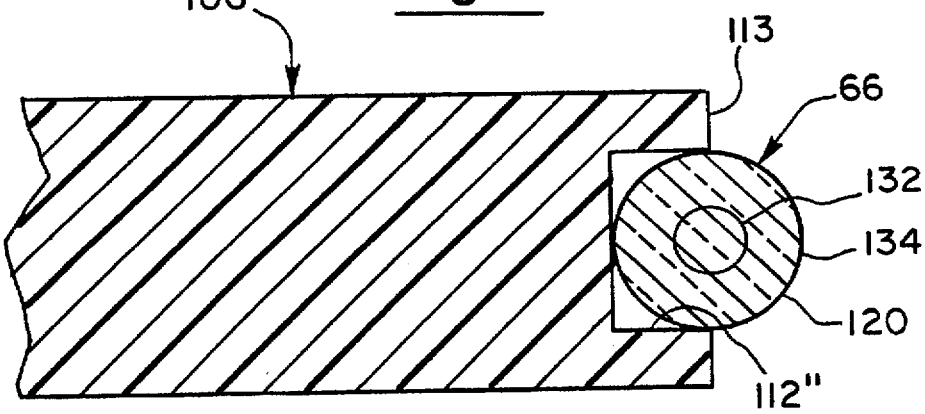
FIG. 9 is another fragmentary cross-sectional view similar to FIG. 7, but with a square-shaped groove cross-section.

An alternative embodiment support block 106 shown in FIG. 8 is similar to the support block 106' in FIG. 7, but the groove 112' has a triangular rather than semicircular shape. Another embodiment support block 106" shown in FIG. 9 has a groove 112" with a square cross-section. In both the 106' and 106" support block embodiments, it is still preferable to protect the fluorescent optical fiber 66 while leaving sufficient peripheral surface 120 exposed to capture incident light rays 122. Therefore, about 30 percent to 70 percent of the diameter of the fluorescent optical fiber 66 may protrude radially beyond the end surface 113, but preferred to be about 50 percent.

Figure 10:
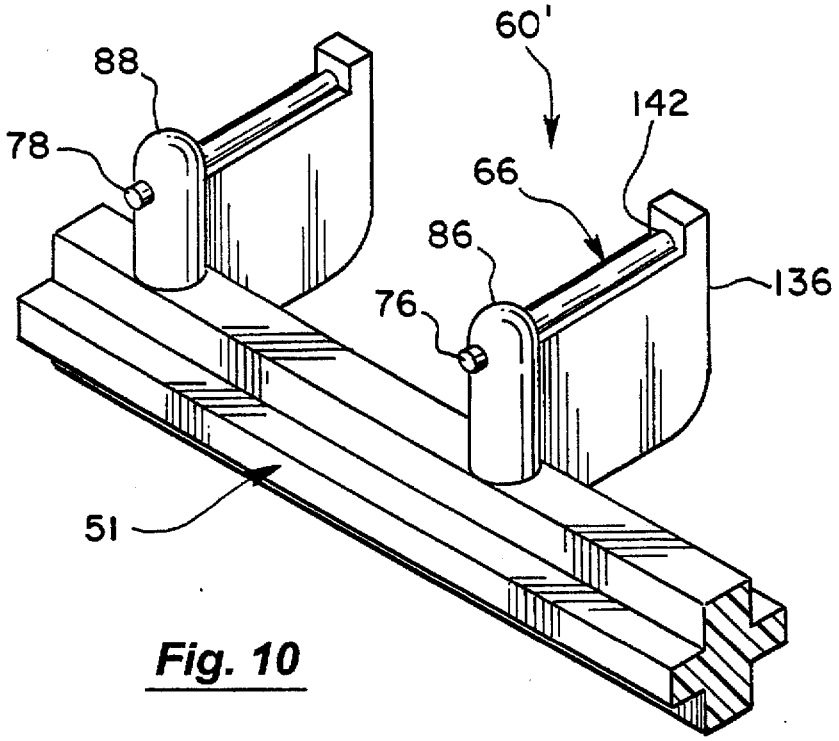
FIG. 10 is an isometric view of an alternate embodiment fluorescent fiber optic sight marker according to this invention mounted on the sight strut of a slingshot.
Figure 11:
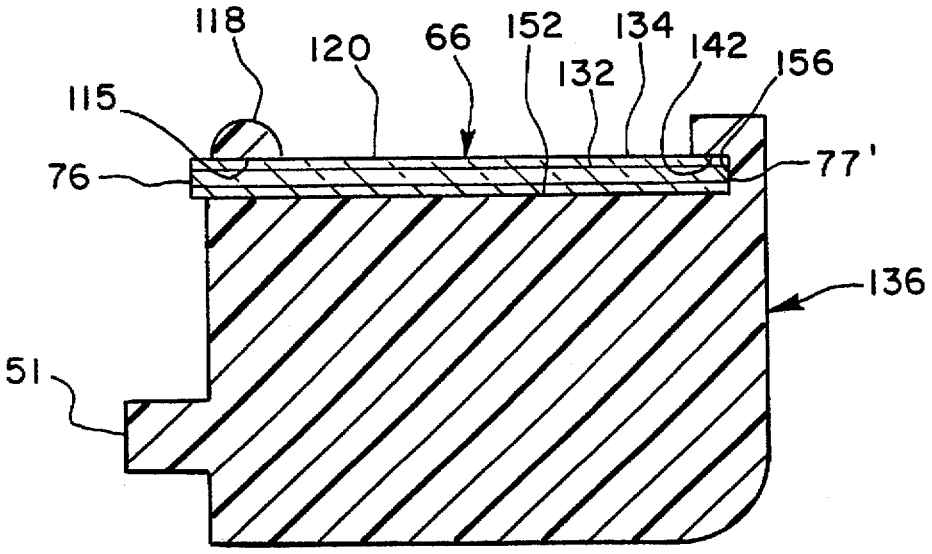
FIG. 11 is a cross-sectional view from an orientation similar to FIG. 5, but showing the cross-section of the FIG. 10 embodiment.

While the curved support block 106 and trough 112 of the embodiments described above have the advantages of increasing probability of capturing direct light from some angle as well as providing two sight markers 76, 77 with one fluorescent optical fiber 66, another embodiment with a straight trough 112, thus straight fluorescent optical fiber 66 nest and less light loss due to no curvature, is shown in FIGS. 10 and 11. This FIGS. 10 and 11 embodiment still shows one end 76 of fluorescent optical fiber 66 extending transversely through a hole 115 in the sight bar 86, but the other end 77' is anchored in a hole 142 in the block 156 that is an axial extension of the straight trough 152. It is still desirable to have about 30 to 70 percent, preferably about 50 percent, of the diameter of the fluorescent optical fiber 66 protrude outward beyond the end surface 154 of the block 136 to protect and support the fluorescent optical fiber 66 while exposing a substantial portion of the peripheral surface 120 to incident light 122. In this embodiment, a reflective surface 156 at the end of hole 142 can be provided to reflect emitted visible light back into the end 77' of the fluorescent optical fiber 66 to reduce light loss.

Of course, other curvature configurations of support block surfaces and troughs can also be used, such as one-quarter circle instead of the semicircle or straight embodiments described above or any extent over or under those configurations while still providing the fluorescent optical fiber nesting for protection while capturing light energy for fluorescent illumination of the sight markers according to this invention.

The foregoing description is considered as illustrative only of the principles of the invention. Furthermore, since a number modifications and changes will readily occur to those skilled in the art, it is not desired to limit the invention to the exact construction and process shown described above. Accordingly, all suitable modifications and equivalents may be resorted to falling within the scope of the invention as defined by the claims which follow.

The embodiments of the invention in which an exclusive property or privilege is claimed are defined as follows:

1. Fiber-optic sight marker apparatus, comprising:

an elongated sight bar with a support block; and an elongated optical fiber with a first end, a first end portion that terminates at said first end, a second end, a second end portion that terminates at said second end, and an elongated midportion that extends between the first end portion and the second end portion, said elongated midportion having a peripheral surface that is transparent to visible and nonvisible light radiation, and said first end portion and said second end portion of said optical fiber being held by said sight bar such that the first and second ends face a user, and said midportion of said optical fiber being nested on said support block.

2. The fiber optic sight marker apparatus of claim 1, wherein the optical fiber is fluorescent, wherein the support block has an elongated trough forming a support surface extending into said support block and the midportion of the fluorescent optical fiber is positioned in said elongated trough in contact with the support surface.

3. The fiber optic sight marker apparatus of claim 2, wherein only a portion of the elongated peripheral surface of the fluorescent optical fiber is positioned in the trough leaving a remaining portion of the elongated peripheral surface of the fluorescent optical fiber protruding out of the trough.

4. The fiber optic sight marker apparatus of claim 3, wherein the support block has a substantially semicircular support surface and the first and the second end portions of the fluorescent optical fiber also extends through said sight bar.

5. The fiber optic sight marker apparatus of claim 3, wherein said elongated sight bar has a first end and a second end, and wherein the first end portion of the fluorescent optical fiber extends transversely through said elongated sight bar adjacent the first end of the elongated sight bar and the second end portion of the fluorescent optical fiber extends transversely through said elongated sight bar adjacent the second end of the elongated sight bar.

6. The fiber optic sight marker apparatus of claim 5, wherein said elongated cylindrical peripheral surface has a diameter no more than about one-half of which protrudes out of the trough.

7. The fiber optic sight marker apparatus of claim 6, wherein said trough has a semicircular cross-section with a diameter that is approximately the same as the diameter of the elongated cylindrical peripheral surface of the fluorescent optical fiber.

8. The fiber optic sight marker apparatus of claim 6, wherein said trough has a polygonal cross-section and no more than about one-half of the diameter of the elongated cylindrical peripheral surface protrudes radially outward from said trough.

9. The fiber optic sight marker apparatus of claim 8, wherein said polygonal cross-section is triangular.

10. The fiber optic sight marker apparatus of claim 8, wherein said polygonal cross-section is square.

11. The fiber optic sight marker apparatus of claim 5, wherein said elongated sight bar has a midsection between the first end and the second end of the elongated sight bar, said midsection extending in opposite directions from an elongated strut that is mounted pivotally on a yoke branch of a slingshot.

12. The fiber optic sight marker of claim 1, wherein said optical fiber is doped with a fluorescent pigment that emits substantially only one visible light spectrum color.

13. A sling shot comprising:

a handle;

a pair of yoke branches coupled to the handle;

a strut pivotally coupled to one of the yoke branches;

a sight bar having support block that is coupled to the strut such that the sight bar extends perpendicularly from the strut; and an elongated optical fiber with a first end, a second end, and a midportion, wherein the optical fiber is coupled to the support block such that the midportion is exposed to receive light, and wherein one of the ends is held by the sight bar such that it faces a user and is spaced apart from the strut.

14. A slight shot as in claim 13, wherein the sight bar has a pair of ends which extend from opposite sides of the strut, and wherein one of the ends of the optical fiber extends through one end of the sight bar, and the other end of the optical fiber extends through the other end of the sight bar, with both ends of the optical fiber facing the user.

* * * * *